US007963522B2

(12) United States Patent
Hoover

(10) Patent No.: US 7,963,522 B2
(45) Date of Patent: Jun. 21, 2011

(54) INTERNAL SLIDING BAFFLES FOR CONTROLLING AIR FLOW IN A VACUUM TRANSPORT

(75) Inventor: Linn C. Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 217 days.

(21) Appl. No.: 12/482,592

(22) Filed: Jun. 11, 2009

(65) Prior Publication Data

US 2010/0314828 A1 Dec. 16, 2010

(51) Int. Cl.
*B65H 29/32* (2006.01)

(52) U.S. Cl. ..... 271/197; 271/276; 271/196; 271/96; 271/94; 271/194

(58) Field of Classification Search ..... 271/197, 271/276, 196, 96, 94, 194
See application file for complete search history.

(56) References Cited

U.S. PATENT DOCUMENTS 3,845,950 A * 11/1974 Kuzniak ..... 271/194
4,411,420 A * 10/1983 Louis et al. ..... 271/276
6,357,869 B1 * 3/2002 Rasmussen et al. ..... 347/102
6,672,720 B2 * 1/2004 Smith ..... 347/104

* cited by examiner

*Primary Examiner* — Stefanos Karmis
*Assistant Examiner* — Luis A Gonzalez
(74) *Attorney, Agent, or Firm* — Ronald E. Prass, Jr.; Prass LLP

(57) ABSTRACT

A vacuum control assembly for use in an image production device is provided. The assembly has a plenum having a vacuum inlet; a perforated plate fluidly connected to the plenum, the perforated plate having a plurality of perforations; a baffle plate connected to an inside of the plenum such that the baffle plate can slide relative to the perforated plate and can pivot relative to the perforated plate; and a protrusion on the inside of the plenum. The baffle plate is capable of sliding relative to the perforated plate between a closed position and an open position, the closed position being where the baffle plate causes the vacuum inlet to be fluidly connected to a first plurality of the perforations, and the open position being where the baffle plate is pivoted away from the perforated plate, causing the vacuum inlet to be fluidly connected to a maximum number of the perforations. The maximum number is greater than the first plurality, and the baffle plate is pivoted into the open position by coming in contact with the protrusion.

20 Claims, 7 Drawing Sheets

INTERNAL SLIDING BAFFLES FOR CONTROLLING AIR FLOW IN A VACUUM TRANSPORT

BACKGROUND

Disclosed herein is a system and method for controlling air flow in a vacuum transport.

An example of an application for a system for controlling air flow in a vacuum transport is a photocopier or printer that handles media of different sizes.

In some photocopiers and printers, sheet media is moved by way of a vacuum transport. Different size sheets cause vacuum to be lost unless the area over which vacuum is applied can be changed to accommodate the different sized sheets.

SUMMARY

A vacuum control assembly for use in an image production device is provided. The assembly has a plenum having a vacuum inlet; a perforated plate fluidly connected to the plenum, the perforated plate having a plurality of perforations; a baffle plate connected to an inside of the plenum such that the baffle plate can slide relative to the perforated plate and can pivot relative to the perforated plate; and a protrusion on the inside of the plenum. The baffle plate is capable of sliding relative to the perforated plate and being positioned anywhere between a closed position and a full open position, the closed position being where the baffle plate causes the vacuum inlet to be fluidly connected to a first plurality of the perforations, and the full open position being where the baffle plate is pivoted away from the perforated plate, causing the vacuum inlet to be fluidly connected to a maximum number of the perforations. The maximum number is greater than the first plurality, and the baffle plate is pivoted into the open position by coming in contact with the protrusion.

DETAILED DESCRIPTION

Figure 1:
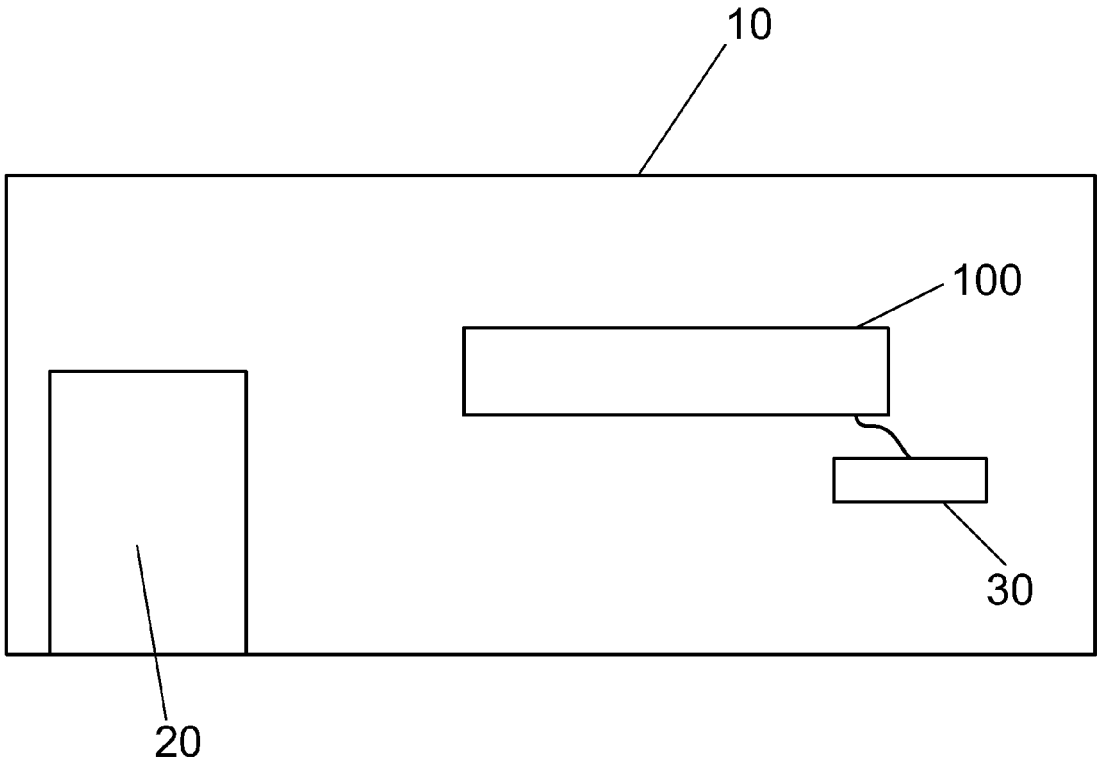
FIG. 1 is a schematic diagram of an exemplary system in accordance with one possible embodiment of the disclosure.

Aspects of the embodiments disclosed herein relate to a system and method for controlling vacuum in a vacuum transport system. For example, a printer can use embodiments of the disclosure to move sheets of media with a vacuum transport while reducing the amount of vacuum needed compared to conventional systems.

The disclosed embodiments may include a vacuum control assembly for use in an image production device. The assembly has a plenum having a vacuum inlet; a perforated plate fluidly connected to the plenum, the perforated plate having a plurality of perforations; a baffle plate connected to an inside of the plenum such that the baffle plate can slide relative to the perforated plate and can pivot relative to the perforated plate; and a protrusion on the inside of the plenum. The baffle plate is capable of sliding relative to the perforated plate between a closed position and an open position, the closed position being where the baffle plate causes the vacuum inlet to be fluidly connected to a first plurality of the perforations, the open position being where the baffle plate is pivoted away from the perforated plate, causing the vacuum inlet to be fluidly connected to a maximum number of the perforations. The maximum number is greater than the first plurality, and the baffle plate is pivoted into the open position by coming in contact with the protrusion.

In particular embodiments, the baffle plate is capable of sliding relative to the perforated plate between a closed position and a full open position, the closed position being where the baffle plate causes the vacuum inlet to be fluidly connected to a first plurality of the perforations, intermediate positions being where the baffle plate causes the vacuum inlet to be fluidly connected to a larger number of the perforations, and the full open position being where the baffle plate is pivoted away from the perforated plate, causing the vacuum inlet to be fluidly connected to a maximum number of the perforations. The maximum number is greater than the first plurality, and the baffle plate is pivoted into the open position by coming in contact with the protrusion. The baffle plate position can be determined by the width of the media being transported so that the baffle fluidly connects only the perforations covered by the media to the vacuum inlet.

The disclosed embodiments may further include an image production device. The device has a media transport assembly having a plenum having a vacuum inlet, a perforated plate fluidly connected to the plenum, the perforated plate having a plurality of perforations, a baffle plate connected to an inside of the plenum such that the baffle plate can slide relative to the perforated plate and can pivot relative to the perforated plate, and a protrusion on the inside of the plenum. The baffle plate is capable of sliding relative to the perforated plate between a closed position and an open position, the closed position being where the baffle plate causes the vacuum inlet to be fluidly connected to a first plurality of the perforations, the open position being where the baffle plate is pivoted away from the perforated plate, causing the vacuum inlet to be fluidly connected to a maximum number of the perforations. The maximum number is greater than the first plurality, and the baffle plate is pivoted into the open position by coming in contact with the protrusion. The device also has a transport belt for transporting a sheet of media across the perforated plate; and a media storage compartment for storing sheets of the media.

The disclosed embodiments may further include a method for controlling vacuum in an image production device. The method includes providing an image production device having a plenum having a vacuum inlet, a perforated plate fluidly connected to the plenum, the perforated plate having a plurality of perforations, a baffle plate connected to an inside of the plenum such that the baffle plate can slide relative to the perforated plate and can pivot relative to the perforated plate, a protrusion on the inside of the plenum, a transport belt for transporting a sheet of media across the perforated plate; and a media storage compartment for storing sheets of the media. The method also includes sliding the baffle plate relative to the perforated plate between a closed position and an open position, the closed position being where the baffle plate causes the vacuum inlet to be fluidly connected to a first plurality of the perforations, the open position being where the baffle plate is pivoted away from the perforated plate, causing the vacuum inlet to be fluidly connected to a maximum number of the perforations, the maximum number is greater than the first plurality, and the baffle plate is pivoted into the open position by coming in contact with the protrusion.

FIG. 1 shows an example of an embodiment of a printing device in accordance with the disclosure. In FIG. 1, printing device 10 has a media storage area 20, a controller 30, and a vacuum transport 100. Printing device 10 can be, for example, a photocopier or a printer. In this example, media is stored in media storage area 20 and is fed to vacuum transport 100. Controller 30 controls vacuum transport 100.

Figure 2:
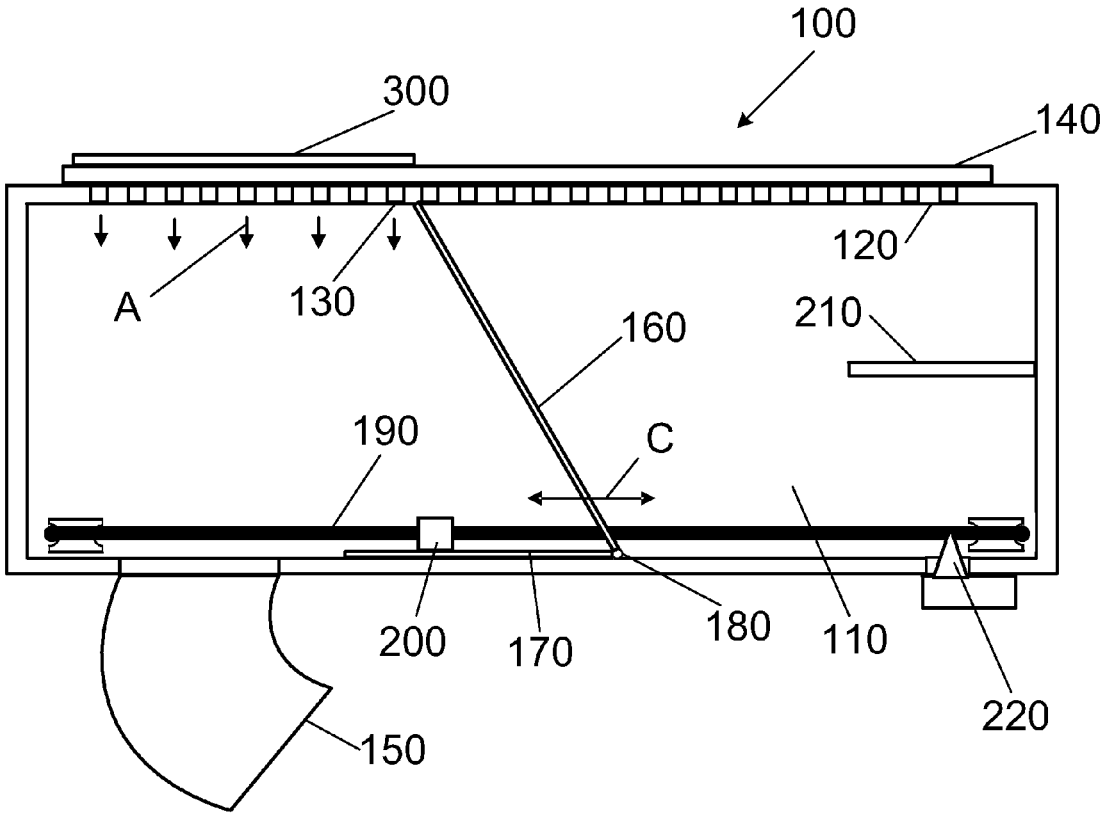
FIG. 2 is an exemplary diagram of a vacuum control system in accordance with one possible embodiment of the disclosure at a first position.

FIG. 2 is an end view of an example of a vacuum transport 100 in accordance with an embodiment of the disclosure. Vacuum transport 100 has a plenum 110 for containing a vacuum. Vacuum is applied to plenum 110 through a vacuum blower inlet 150 which is fluidly connected to a vacuum blower or other vacuum source (not shown). In this example, the upper surface of plenum 110 is a perforated plate 120 having a plurality of holes 130. A transport belt 140 moves across perforated plate 120 in a process direction into the page of FIG. 2 to transport a sheet of media 300. Arrows A represent the negative pressure in plenum 110 being applied through perforated plate 120 and transport belt 140 to media sheet 300. This negative pressure keeps media sheet 300 secured to transport belt 140 while media sheet 300 is moved by transport belt 140 across perforated plate 120.

A sliding baffle mechanism is provided to adjustably separate plenum 110 into an area that is subjected to vacuum and an area that is not. A baffle plate 160 is connected to a base plate 170 by a spring loaded hinge 180. Spring loaded hinge 180 urges baffle plate 170 into contact with perforated plate 120. A spring separate from the hinge may also be used. Base plate 170 (and therefore baffle plate 160) is moved in direction C by a belt 190 that is connected to base plate 170 by a belt connection 200. Belt 190 can be moved by a stepper motor or other controllable drive mechanism. A baffle home sensor 220 limits the travel of base plate 170. As baffle plate 160 moves in direction C, more or fewer holes 130 are exposed to the vacuum inside plenum 110. In the example shown in FIG. 2, baffle plate 160 is moved to correspond to the width of a particular media sheet 300 being used.

A protrusion 210 is shown extending from one of the side walls of plenum 110. The function of protrusion 210 will be explained with reference to FIG. 3.

Figure 3:
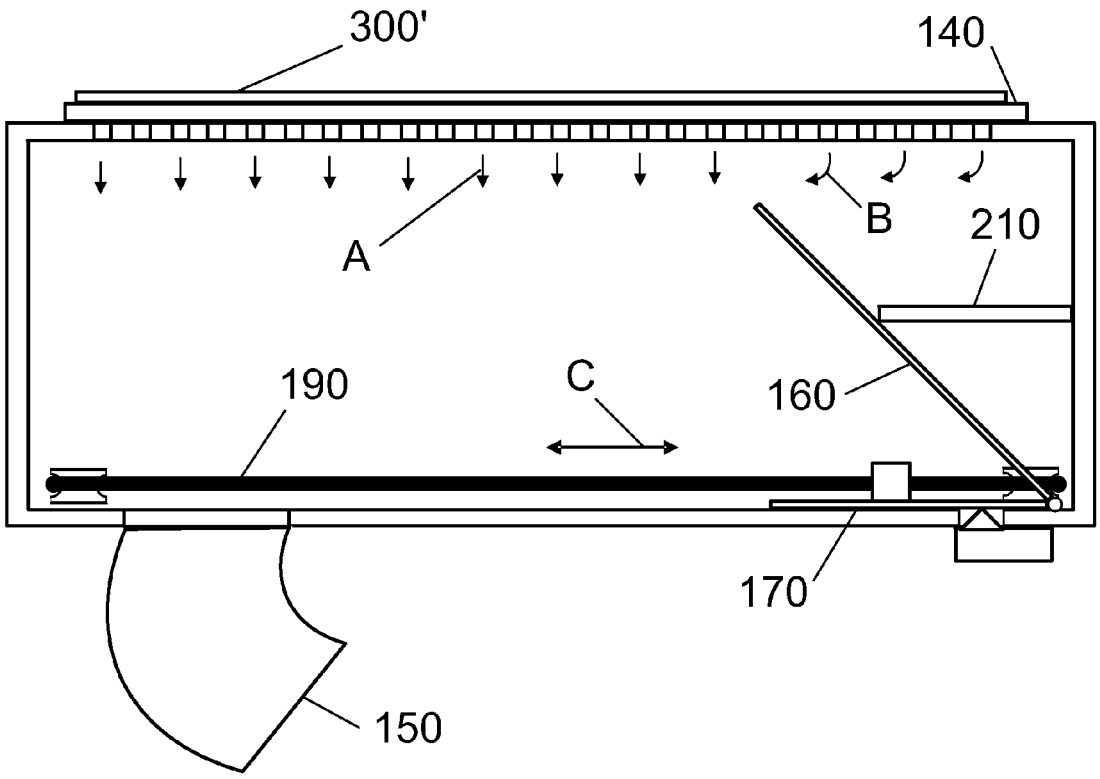
FIG. 3 is an exemplary diagram of a vacuum control system in accordance with one possible embodiment of the disclosure at a second position.

FIG. 3 shows vacuum transport 100 with baffle plate 160 in an open position in order to accommodate a wider media sheet 300'. In this position, baffle plate 160 has been moved (to the right in FIG. 3) into a position at which baffle plate 160 contacts protrusion 210 such that baffle plate 160 pivots relative to base plate 170 (against the force of spring loaded hinge 180) and no longer contacts perforated plate 120. In this position, all of the holes in perforated plate 120 are subjected to the vacuum inside plenum 110. Arrows A and B represent the negative pressure in plenum 110 being applied through perforated plate 120 and transport belt 140 to media sheet 300'.

FIGS. 2 and 3 show an embodiment of the disclosure for an edge registered media path in which baffle plate 160 travels in a cross process direction, that is, in a direction perpendicular to the direction in which media travels across perforated plate 120. A device in which baffle plate 160 travels in the cross process direction can be particularly useful for limiting vacuum application based on the width of the media being used. Although only two different widths of media (300 and 300') are shown in FIGS. 2 and 3, many different widths of media can be accommodated by simply positioning baffle plate 160 at the appropriate position.

Figure 4:
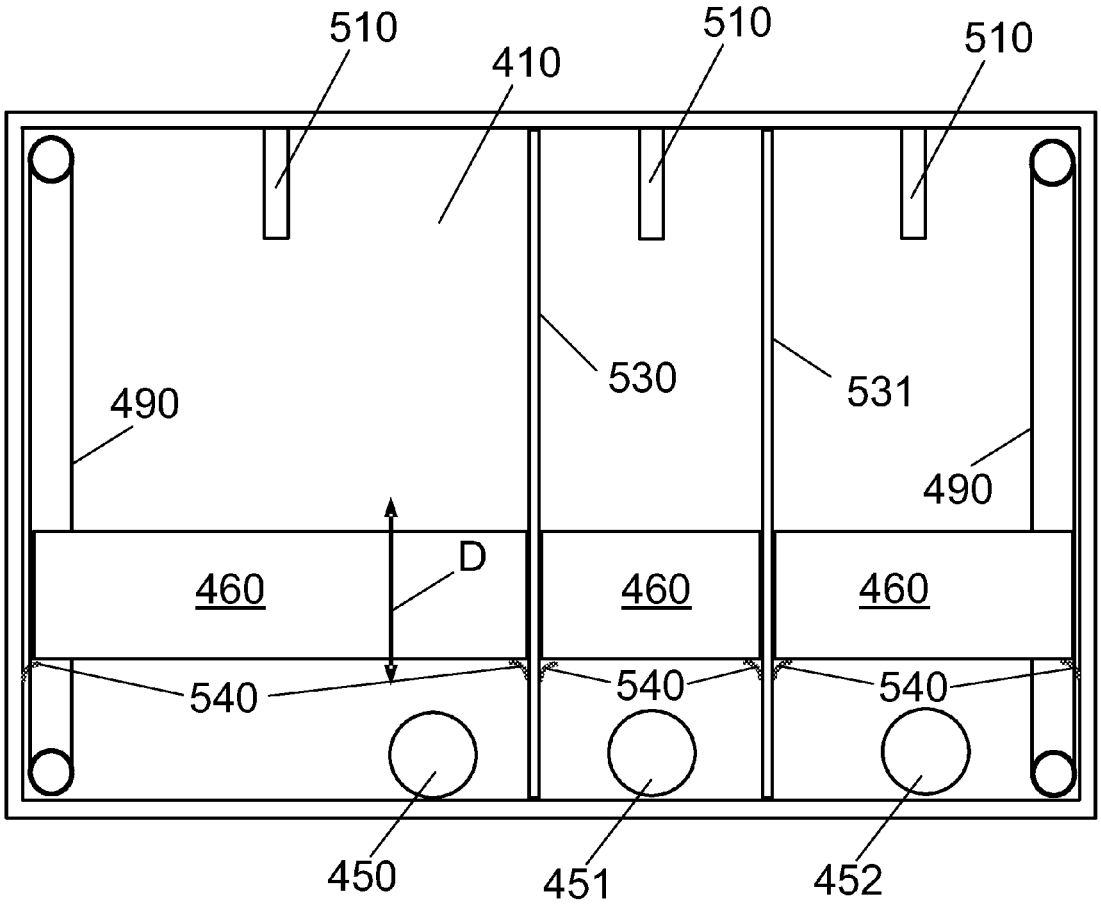
FIG. 4 is an exemplary diagram of a vacuum control system in accordance with one possible embodiment of the disclosure.
Figure 5:
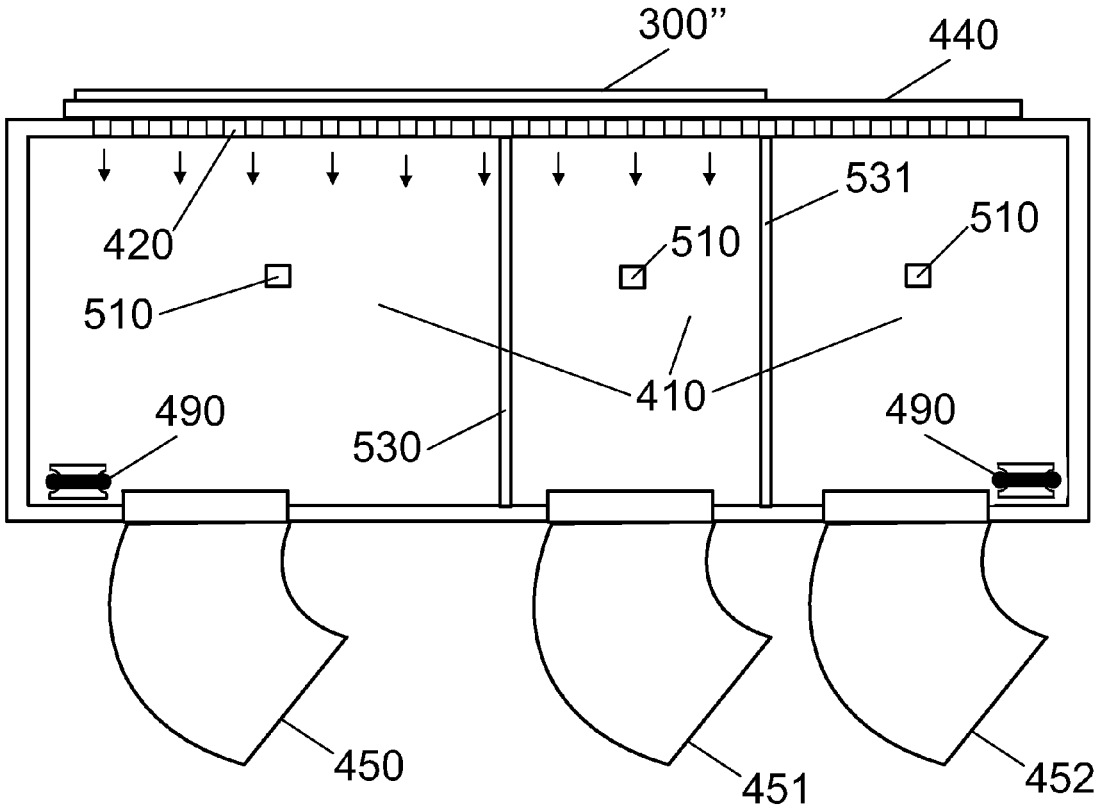
FIG. 5 is an exemplary diagram of the vacuum control system shown in FIG.4.

FIGS. 4 and 5 show an example of an embodiment in accordance with the disclosure in which a baffle plate 460 travels in a process direction, that is, in a direction parallel to the direction in which media travels across perforated plate 420. A device in which baffle plate 460 travels in the process direction can be particularly useful for limiting vacuum application based on the travel of the media across the perforated plate.

FIG. 4 shows a plenum 410 and a baffle plate 460 that moves in a process direction D within plenum 410. Similarly to the embodiment shown in FIGS. 2 and 3, belt 490 moves baffle plate 460 relative to perforated plate 420 to limit which holes in perforated plate 420 are subjected to vacuum. Vacuum is applied to plenum 410 by (in this example three) vacuum blower inlets 450, 451, 452. In this example, two fixed partitions 530, 531 divide plenum 410 into three separate chambers, each being fluidly connected to one of the vacuum blower inlets 450, 451, 452. The purpose of partitions 530, 531 will be discussed below.

As baffle plate 460 moves toward the top of the sheet in FIG. 4, more holes in perforated plate 420 are exposed to the vacuum in plenum 410. As discussed above, baffle plate 460 moves parallel to the direction in which the media sheet moves. In use, baffle plate 460 moves so that it is roughly adjacent to, and preferably just in front of, the leading edge of the media sheet as the media sheet travels relative to perforated plate 420. As a result, sufficient vacuum is applied to properly secure the media sheet to transport belt 440 while preventing vacuum being wasted in front of the media sheet. After the media sheet is no longer positioned over perforated plate 420, baffle plate 460 is quickly returned to its start position (the bottom of the page in FIG. 4, or some other start position) adjacent to the leading edge of the next media sheet.

Similarly to protrusion 210 in FIGS. 2 and 3, one or more protrusions 510 pivot baffle plate 460 into an open position where baffle plate 460 does not contact perforated plate 420 when baffle plate 460 contacts protrusions 510.

Partitions 530, 531 divide plenum 410 into, in this example, three separate chambers. As shown in FIG. 5, the location of partition 531 corresponds to the width of media sheet 300". By providing vacuum to only vacuum blower inlets 450 and 451, sufficient vacuum is provided to secure media sheet 300" to transport belt 440 while at the same time preventing vacuum being wasted. It is noted that although three distinct chambers are shown in this example, any number of chambers can be provided to allow for different sheet widths.

Seals 540 are provided between baffle plate 460 and partitions 530, 531 and the side walls of plenum 410 to prevent or minimize leakage of pressure.

Figure 6:
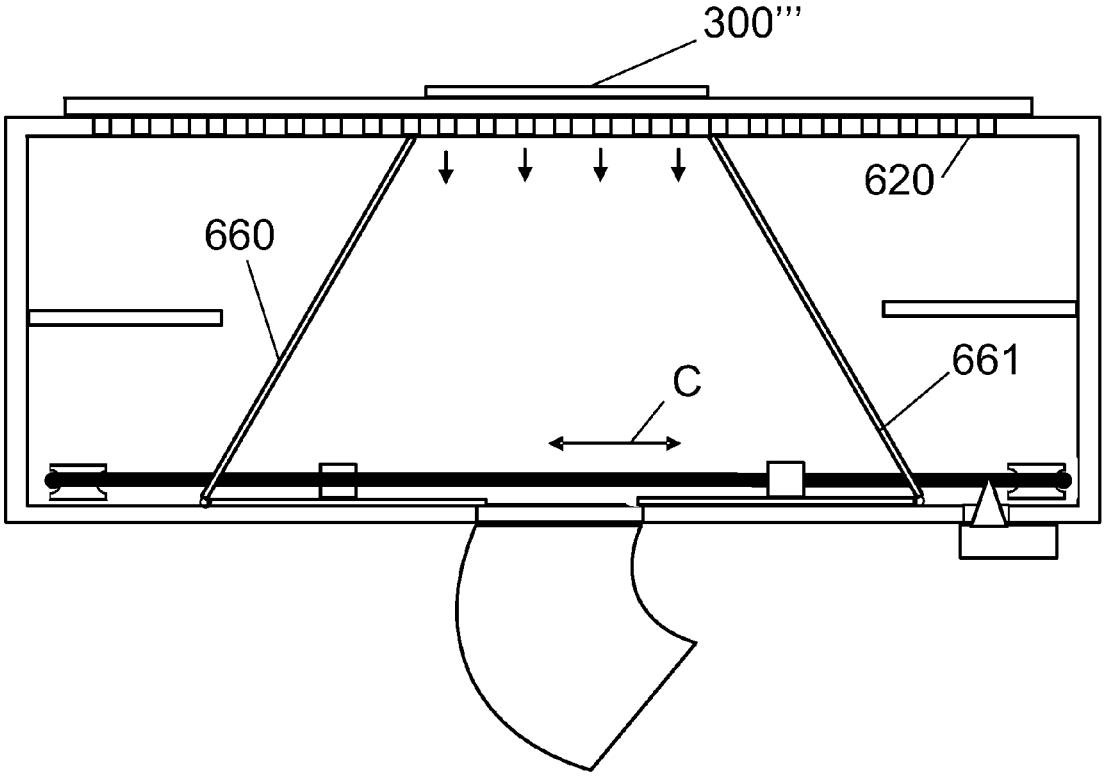
FIG. 6 is an exemplary diagram of a vacuum control system in accordance with one possible embodiment of the disclosure.
Figure 7:
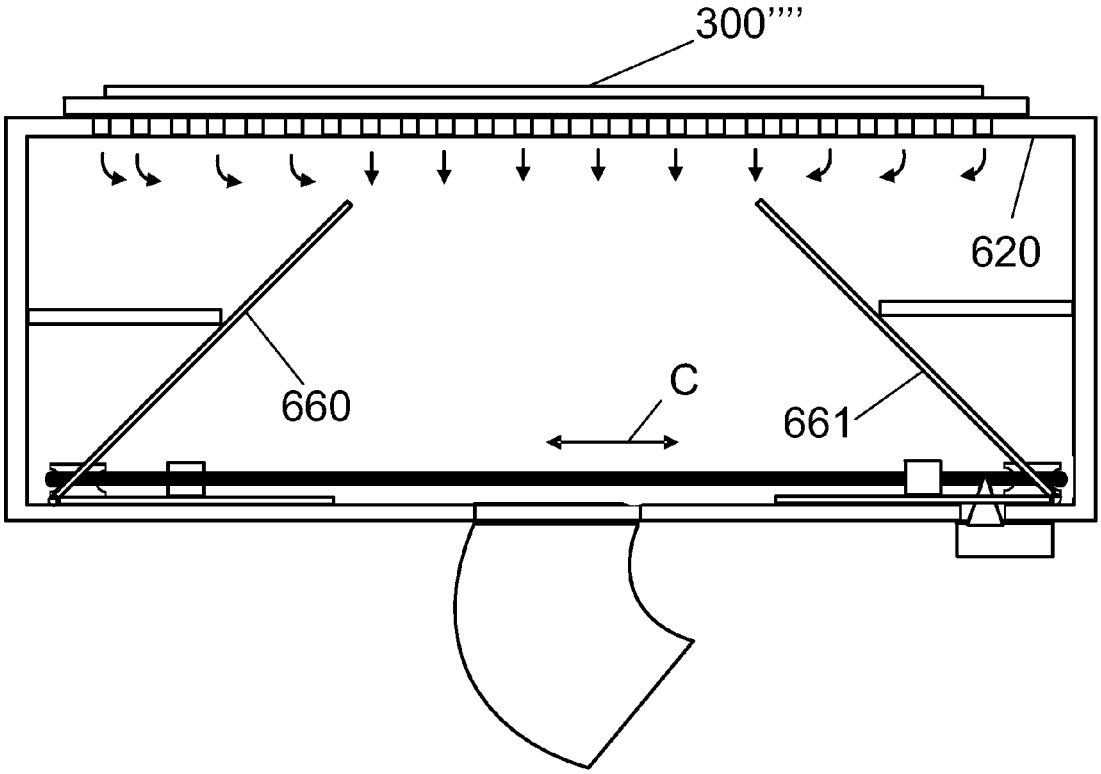
FIG. 7 is an exemplary diagram of the vacuum control system shown in FIG.6.

FIGS. 6 and 7 show an embodiment of the disclosure for a center registered media path in which baffle plates 660 and 661 travel in a cross process direction, that is, in a direction perpendicular to the direction in which media travels across perforated plate 620. A device in which baffle plates 660 and 661 travel in the cross process direction can be particularly useful for limiting vacuum application based on the width of the media being used. Although only two different widths of media (300'41 and 300"") are shown in FIGS. 6 and 7, many different widths of media can be accommodated by simply positioning baffle plates 660 and 661 at the appropriate position.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A vacuum control assembly for use in an image production device, the assembly comprising:

a plenum having a vacuum inlet;

a perforated plate fluidly connected to the plenum, the perforated plate having a plurality of perforations;

a baffle plate connected to an inside of the plenum such that the baffle plate can slide relative to the perforated plate and can pivot relative to the perforated plate; and a protrusion on the inside of the plenum, wherein the baffle plate is capable of sliding relative to the perforated plate between a closed position and an open position, the closed position being where the baffle plate causes the vacuum inlet to be fluidly connected to a first plurality of the perforations, the open position being where the baffle plate is pivoted away from the perforated plate, causing the vacuum inlet to be fluidly connected to a maximum number of the perforations, the maximum number is greater than the first plurality, and the baffle plate is pivoted into the open position by coming in contact with the protrusion.

2. The assembly of claim 1, further comprising a spring that urges the baffle plate into the closed position.

3. The assembly of claim 2, further compromising a controller that controls the baffle plate to multiple different closed positions, each of which causes a different number of the perforations to be fluidly connected to the vacuum inlet.

4. An image production device, comprising:

a media transport assembly having a plenum having a vacuum inlet;

a perforated plate fluidly connected to the plenum, the perforated plate having a plurality of perforations;

a baffle plate connected to an inside of the plenum such that the baffle plate can slide relative to the perforated plate and can pivot relative to the perforated plate; and a protrusion on the inside of the plenum, wherein the baffle plate is capable of sliding relative to the perforated plate between a closed position and an open position, the closed position being where the baffle plate causes the vacuum inlet to be fluidly connected to a first plurality of the perforations, the open position being where the baffle plate is pivoted away from the perforated plate, causing the vacuum inlet to be fluidly connected to a maximum number of the perforations, the maximum number is greater than the first plurality, and the baffle plate is pivoted into the open position by coming in contact with the protrusion;

a transport belt for transporting a sheet of media across the perforated plate; and a media storage compartment for storing sheets of the media.

5. The device of claim 4, further comprising a spring that urges the baffle plate into the closed position.

6. The device of claim 5, wherein the baffle plate has multiple different closed positions, each of which causes a different number of the perforations to be fluidly connected to the vacuum inlet.

7. The device of claim 6, wherein the baffle plate slides in a cross-process direction, the cross-process direction being a direction perpendicular to a direction in which the sheet of media is to be transported by the transport belt.

8. The device of claim 7, further comprising a controller that controls each of the closed positions to correspond to a different width of media to be moved by the transport belt.

9. The device of claim 6, wherein the baffle plate slides in a process direction, the process direction being a direction parallel to a direction in which the sheet of media is to be transported by the transport belt.

10. The device of claim 9, further comprising a controller that controls the position of the baffle plate such that the baffle plate moves ahead of a leading edge position of the sheet of media to be transported by the transport belt.

11. The device of claim 10, further comprising at least one fixed baffle positioned inside the plenum.

12. The device of claim 11, wherein the at least one fixed baffle is parallel to the process direction and divides the plenum into at least two separate chambers.

13. The device of claim 12, wherein each separate chamber is fluidly connected to a separate vacuum inlet.

14. The device of claim 13, wherein the position of each of the fixed baffles corresponds to a width of media to be transported by the transport belt.

15. A method for controlling vacuum in an image production device, the method comprising:

providing an image production device having a plenum having a vacuum inlet;

a perforated plate fluidly connected to the plenum, the perforated plate having a plurality of perforations;

a baffle plate connected to an inside of the plenum such that the baffle plate can slide relative to the perforated plate and can pivot relative to the perforated plate;

a protrusion on the inside of the plenum;

a transport belt for transporting a sheet of media across the perforated plate; and a media storage compartment for storing sheets of the media;

sliding the baffle plate relative to the perforated plate between a closed position and an open position, the closed position being where the baffle plate causes the vacuum inlet to be fluidly connected to a first plurality of the perforations, the open position being where the baffle plate is pivoted away from the perforated plate, causing the vacuum inlet to be fluidly connected to a maximum number of the perforations, the maximum number is greater than the first plurality, and the baffle plate is pivoted into the open position by coming in contact with the protrusion.

16. The method of claim 15, wherein the baffle plate is urged into the closed position by a spring.

17. The method of claim 16, further comprising moving the baffle plate into multiple different closed positions, each of which causes a different number of the perforations to be fluidly connected to the vacuum inlet.

18. The method of claim 17, wherein the baffle plate is moved in a cross-process direction, the cross-process direction being a direction perpendicular to a direction in which the sheet of media is to be transported by the transport belt.

19. The method of claim 18, wherein each of the closed positions corresponds to a different width of media to be moved by the transport belt.

20. The method of claim 17, wherein the baffle plate is moved in a process direction, the process direction being a direction parallel to a direction in which the sheet of media is to be transported by the transport belt.

* * * * *